United States Patent [19]

Feher

[11] 4,010,626

[45] Mar. 8, 1977

[54] HOSIERY MACHINE WITH TERRY FORMING APPARATUS

[76] Inventor: Tibor Feher, 5130 Bourret Ave., Apt. 9, Montreal 252, Quebec, Canada

[22] Filed: Feb. 6, 1973

[21] Appl. No.: 330,029

[52] U.S. Cl. ..... 66/93; 66/125 B; 66/177; 66/111

[51] Int. Cl.[2] ..... D04B 35/00; D04B 9/12

[58] Field of Search ..... 66/93, 92, 9 R, 12, 66/125 B, 136, 95, 111, 177

[56] References Cited

UNITED STATES PATENTS

| | | | |
|---|---|---|---|
| 1,777,699 | 10/1930 | McAdams | 66/92 X |
| 1,801,167 | 4/1931 | McAdams | 66/93 X |
| 1,927,683 | 9/1933 | Grothey | 66/136 X |
| 2,392,312 | 1/1946 | Cloutier | 66/95 |
| 2,436,318 | 2/1946 | McDonough | 66/93 |
| 3,226,956 | 1/1966 | White et al. | 66/125 B |
| 3,513,667 | 5/1970 | Billi | 66/95 |
| 3,605,446 | 9/1971 | Crawford, Jr. et al. | 66/92 X |
| 3,757,537 | 9/1973 | York | 66/9 R |
| 3,826,110 | 7/1974 | Holder | 66/9 R |

FOREIGN PATENTS OR APPLICATIONS

| | | | |
|---|---|---|---|
| 620,997 | 1/1927 | France | 66/95 |
| 1,585,051 | 8/1969 | Germany | 66/93 |
| 23,583 | 6/1971 | Japan | 66/9 R |
| 140,941 | 2/1961 | U.S.S.R. | 66/125 B |

*Primary Examiner*—Mervin Stein
*Assistant Examiner*—Andrew M. Falik

[57] ABSTRACT

Knitted underwear, such as panties, panty hose, leotard and the like formed with a terry patch simultaneously knitted with the fabric at the crotch or other areas. The garment is made on a circular seamless hosiery knitting machine. The resulting tube is tailored for the leg openings, then sewn to form the garment. Shaping of the terry patch is effected by using the usual needle selecting device, normally employed for heel patch reinforcement and modified with suitable cams. The machine is modified to use new dial elements, a new throat plate and a new manner of feeding the loop forming yarn and the base yarn above and below the plane of the dial elements respectively. The machine is operated in a new way and can also produce knitted fabric with eyelet pattern.

5 Claims, 20 Drawing Figures

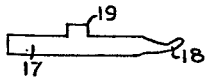
Fig-7
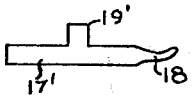
Fig-7A
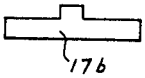
Fig-7B
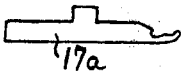
Fig-7C
Fig-7D
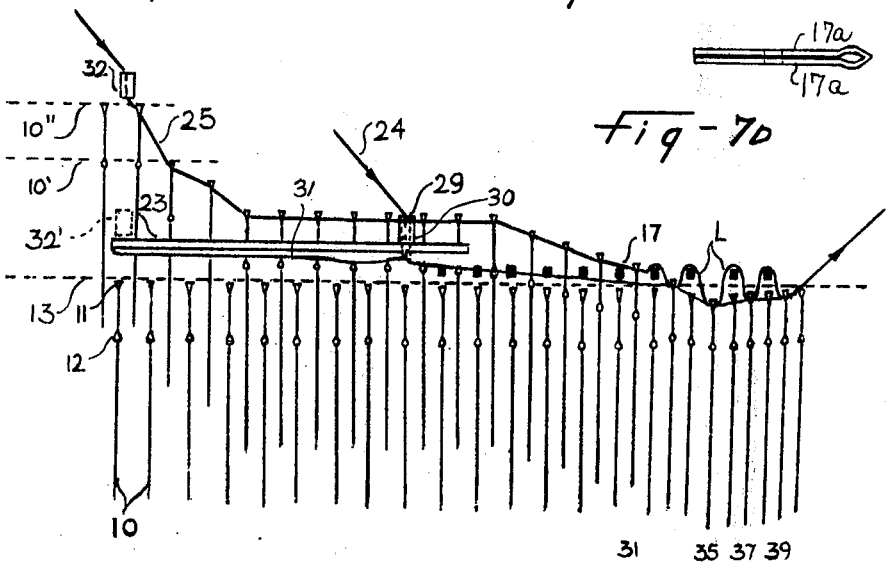
Fig-9
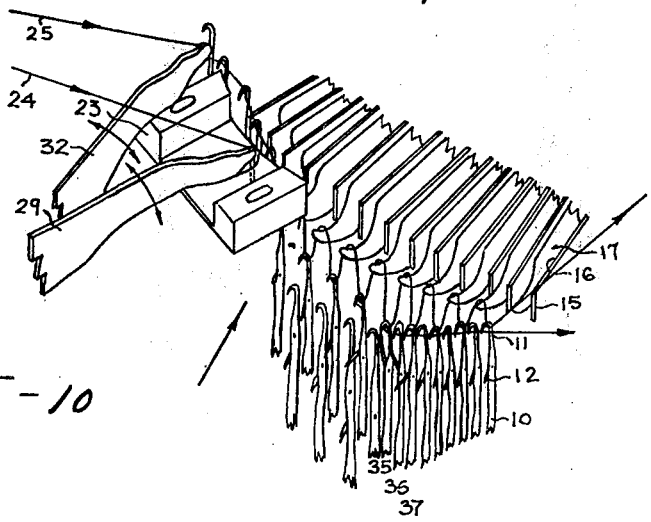
Fig-10

HOSIERY MACHINE WITH TERRY FORMING APPARATUS

The present invention relates to a multifeed circular seamless hosiery knitting machine for making knitted underwear, such as panties, panty hose, leotard and one-piece underwear incorporating simultaneously knitted terry patches.

It is known to manufacture knitted underwear, such as panties, on flat bed or linear full-fashioned machines, which underwear incorporates terry areas, for instance at the crotch. Full-fashioned machines are slower to operate than circular knitting machines due to their reciprocating movement, are very roomy and more expensive to make and to operate than the circular seamless hosiery knitting machine.

It is the general object of the present invention to provide a method and means for making knitted fabric provided at selected areas with patches of terry fabric simultaneously knited with the base fabric and this while using a circular seamless hosiery knitting machine and while the high productivity of the multifeed machine is maintained by knitting at each feed.

It is another object of the present invention to provide a new method of knitting at any feed of a multifeed circular seamless hosiery knitting machines for simultaneously knitting terry fabric and the base fabric.

It is another object of the invention to provide a multifeed circular seamless hosiery knitting machine suitably modified for carrying the above-noted operation.

It is another object of the invention to provide a multifeed circular seamless hosiery knitting machine which can make knitted fabric with eyelets or apertures in any decorative lace pattern.

The foregoing and other objects of the invention will become more apparent during the following disclosure and by referring to the drawings, in which:

FIG. 7 is a side elevation of a modified loop forming element with a short butt and used in the knitting machine;

FIG. 7A is a side elevation of a similar loop forming element but with a long butt;

FIG. 7B is a plain or "blind" element used together with a loop forming element in pairs assuring adequate friction in the slot of the dial;

FIG. 7C is a side elevation of a transfer jack;

FIG. 7D is a top view of a pair of transfer jacks;

FIG. 9 is a schematic developed elevation showing the manner of simultaneously knitting the base fabric with the terry fabric;

FIG. 10 is a partial perspective view of the needles, loop forming elements, dial, throat plate and loop and base yarn feeding fingers and showing the formation of the terry fabric;

In the drawings, like reference characters indicate like elements throughout.

Figure 2:
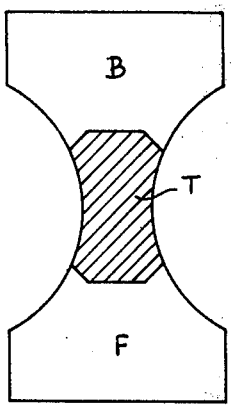
FIG. 2 is a plan view of the blank tailored to form the leg openings and used for making a knitted panty incorporating a simultaneously knitted terry patch at the crotch.
Figure 3:
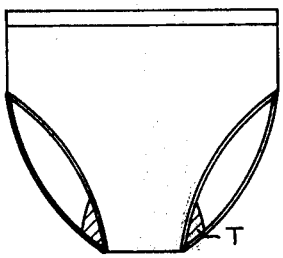
FIG. 3 is a front elevation of the finished panty with elastic waist and leg bands.

In FIG. 2, the lengthwise opened fabric, tailored for the leg openings, is shown with the terry area T. The back portion B and the front section F are folded about the terry crotch and sewn together along their edges, as shown in FIG. 3.

It is to be noted that the curved cuts for the leg openings are made in the tubular fabric. The productivity is substantially increased when the tube is flattened; then the two registering leg openings are cut out, then the tube is folded in half transversely of its longitudinal axis to obtain two middle layers and two outer layers. Then with an overlock machine, the two middle layers are sewn together to make the first side seam and simultaneously the two outer layers are cut off from the two middle layers. After unfolding and inverting the piece and sewing the elastic to the leg openings and to the waist, the panty is completed with the other side seam.

Figure 4:
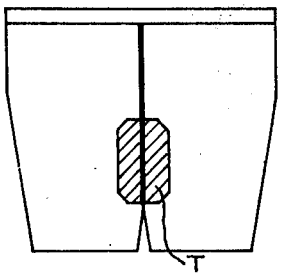
FIG. 4 is an elevation of the top part of a panty hose knitted with a terry crotch with the edges sewn together in the middle of the front and back panels.

FIG. 4 shows how a panty hose can be formed using a circular seamless hosiery knitting machine with a terry patch T at the crotch. Two stockings are knit on the machine with a terry patch and with a portion to eventually form the upper part of the panty hose. This upper part, shown in FIG. 4, forms a body encircling portion when the tubes are sewn together. FIG. 4 shows the reverse side of this panty hose upper part with the terry area on the outside.

A few loop forming elements shall be removed from the dial in the middle of the terry area. A line of plain fabric will appear in the terry fabric to guide the sewing operation. It also helps to provide a smooth, non-irritating seam in the terry patch.

Figure 1:
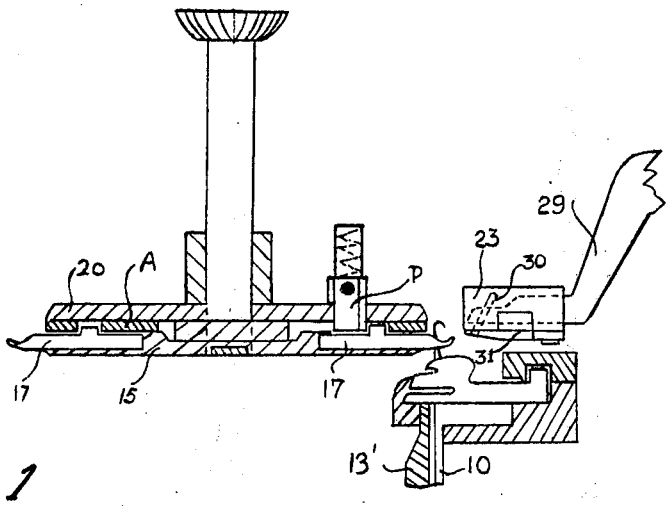
FIG. 1 is a cross-section view of the dial and of the cylinder of the modified machine.

The tubular knitted fabric with simultaneously knitted terry patch is produced on a circular knitting machine and, more particularly, on a multi-feed circular seamless hosiery knitting machine modified to operate in the manner to be hereinafter described. FIG. 1 shows the rotatable dial 15 and a partial section of the rotatable needle cylinder 13′ and their relationship. Dial 15 is coaxial with cylinder 13′ and is rotatable therewith.

Conventional knitting needles 10 with a top hook 11 and pivoted latch 12 are mounted for reciprocating up-and-down movement in the outer slots of a conventional revolving needle cylinder 13′, shown in FIG. 1.

The top edge of the needle cylinder is shown at 13 by the dotted line of FIG. 9 representing also the level at which the last course or wale of knitted fabric is held. Each needle has a butt 14, FIG. 12, engageable with a series of cams to accomplish the knitting operation. The cams are mounted on the stationary body of the knitting machine.

The machine comprises the usual revolving disc-like dial 15 (see FIGS. 1 and 10) having upwardly opening radially extending slots 16 in which are radially movable, between retracted and advanced positions, a series of loop forming elements 17, said elements being modified as compared to the usual transfer jacks and having a smooth upwardly curved hook 18, as shown in FIG. 7, and being made of a flat straight strip of metal throughout their length and provided with a butt 19 upstanding from dial 15.

The loop forming element 17 moves in and out of the dial 15 in a plane at right angles to the up-and-down movement of the needles and at a level above the lowermost positions of the needles and above the top edge 13 of the cylinder. If desired, the level of the dial 15 can be adjusted to obtain different lengths of the terry loops. The dial 15 rotates with the cylinder.

Figure 5A:
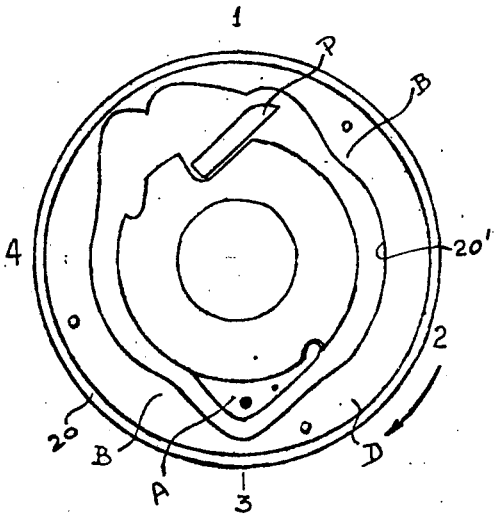
FIG. 5A is a bottom plan view of the dial cap of a four-feed circular seamless hosiery knitting machine modified and provided with stationary cams for making knitted fabric with simultaneously knitted terry patches.

A stationary dial cap 20, the underside of which is shown in FIG. 5A, is fitted over the dial 15. It has at its underside push-out cam A and the conventional make-up plunger cam P. It also has pull-in section B of cam ring D defining therebetween a groove or cam race 20′ receiving the butts 19 of the loop forming elements 17 for operating the latter. The dial cap 20 shown is for a four-feed circular hosiery knitting machine, the feed locations being indicated at 1, 2, 3, and 4 respectively. There is one fixed push-out cam A and the regular make-up plunger P. The pull-in cam sections B are located such that they will retract the fully advanced loop-forming elements 17 at the feeds 1 and 3, resulting in loop formation of the loop yarn for the terry fabric at every second course. The relationship between push-out cam A and the cylinder needle raising cam and stitch cams is similar to that existing in a circular machine designed for rib fabric. In the method of operation of FIG. 9, the loop-forming elements 17 in their advanced position extend above and are aligned with every second needle 10. Only the elements 17 which are making a protruding movement and those which are fully protruding, are shown. The selected and raised needles are arranged to move to an uppermost position when the shaped terry fabric is being knitted.

The circular knitting machine is provided with a modified throat plate 23, shown in FIGS. 6, 6A, 6B, 9 and 10, when working in accordance with the method shown in FIG. 9.

Figure 6:
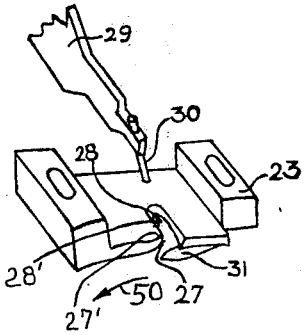
FIG. 6 is a perspective view of a throat plate and yarn finger used in the knitting machine.

FIG. 6 shows in perspective view a modified throat plate 23 with slot 28 and bow 31 when the finger 29 for feeding the base yarn 24 is in elevated position. Bow 31 restricts the opening of slot 28, as indicated at 27. Slot 28 has a substantially uniform width and has a downstream edge 28′ which has a curved terminal corner edge 27′. The bow 31, which has a wedged underface, has an end portion or tip which extends beyond the downstream edge 28′ of slot 28. The corner edge 27′ defines one side of opening 27.

Figure 6A:
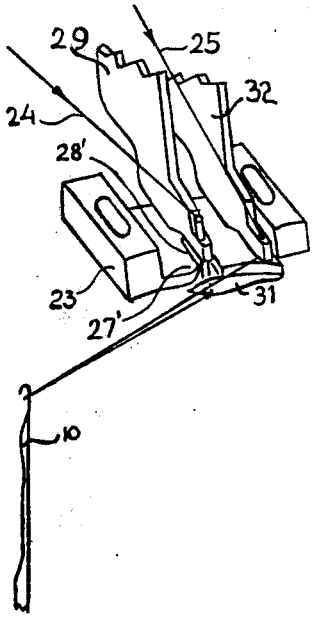
FIG. 6A is a perspective view of the throat plate and yarn fingers when the base yarn is fed together with the loop yarn.

FIG. 6A shows both base yarn finger 29 and loop yarn finger 32 in lowered position for feeding the base yarn 24 and loop yarn 25. Fingers 29 and 32 are pivoted on the machine frame for vertical movement.

The base yarn 24 freely passes through the slot 28 in the up and down movement of the yarn finger 29. Finger 29 carries a yarn feeding tube 30 which just protrudes from the underface of throat plate 23 but not from the underface of bow 31 in the lowered position of base yarn finger 29 (see FIG. 1).

Figure 6B:
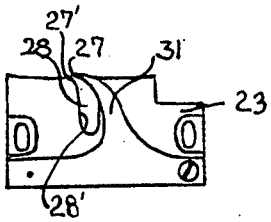
FIG. 6B is a bottom plan view of the throat plate.

FIG. 6B shows the bottom view of the throat plate 23 with the shape of the bow 31 screwed and pinned to the throat plate underneath. It also shows the throat plate slot 28 having its opening 27 restricted by bow 31. Bow 31 points in the direction of needle movement indicated by arrow 50 in FIG. 6. Bow 31 is a needle latch guide which moves the latches down and prevents their damage by the edge of throat plate 23.

The conventional dial of the seamless hosiery machine is made with slots widened at the outward end of the dial to receive the hook portion of the transfer jacks 17*a* forming an "O" shape when used in pairs, FIG. 7D. For forming loops and to release them in each or in every other or fourth course, the loop forming elements 17 can be used individually or in pairs, as FIGS. 7, 7A, 7B, 7C, and 7D show.

Figure 8:
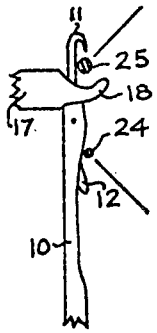
FIG. 8 is a partial side elevation of a knitting needle and loop forming element showing their relationship in the advanced position of the latter.

When using the regular dial, made with widened slots at the outer end, the loop forming elements can be used in pairs: element 17 of FIG. 7 with "blind" element 17*b* of FIG. 7B, or element 17′ of FIG. 7A with a high butt "blind" element, or individually. Only the hook of the loop forming element reaches the line of the needles when they are fully protruded. The relationship between the partly retracted needle and the fully advanced loop forming element is shown in FIG. 8. The blind element moves only to the outward edge of the dial.

The loop forming elements, used in pairs or individually, are always made of about 25–30 percent heavier material than the original i.e., "blind" element. If the loop forming element is used individually, a dial made with slots all the way with the same width is more advantageous. The relationship between the needles in the cylinder and the loop forming elements in the dial could be arranged in two orders. The loop forming elements are set in alignment with the needles or between the needles. In case of coarse machines, the latter arrangement is more advantageous, because of less operation needed to knit terry area than in case of fine gauge machines when the needles shall be selected for knit position and kept down in welt position under the throat plate to provide room for the protruding loop forming elements.

In the modified multifeed seamless hosiery knitting machines, the dial cap 20, illustrated in FIG. 5A, is provided with the conventional plunger P for engaging the butts of the loop forming elements.

Two sets of loop forming elements are provided: one set with the short butt 19, as shown in FIG. 7, and the other set with a longer butt 19′, as shown in FIG. 7A; elements of one set follow the elements of the other set around the dial; otherwise, the structure and shape of the loop forming elements of the two sets are identical. During rotation of the dial 15, along with the needle cylinder 13′, the plunger P in dial cap moves down to a level to reach only the high butts 19′ to advance the high butt loop forming elements 17', then moves further down to reach and push out the low butts 19 of the other set of the loop forming elements 17. The downwardly moving needles pull or lay the yarn into the hooks of the protruded loop forming elements.

In FIG. 9, the loop forming elements 17 are arranged to extend above and aligned with every second needle. The loop forming elements 17 are in advanced position, as the filled square shapes illustrate them till after the cast-off needle No. 35, for instance at needle 39, where the loop forming elements are gradually retracted. The loop forming elements, when they are in retracted position, are not shown. FIG. 9 alo shows a selection of the needles when they are raised to their uppermost height shown by dotted line 10'' to knit shaped area and kept down just below the edge 13 of the needle cylinder in the so-called welt position. The dotted line shown at 10' shows the regular knitting level of the needles. Loop yarn 25 is fed to the needles above the loop-forming elements 17, whether at the selected uppermost level 10'' for knitting shaped terry areas or at the regular knitting level 10' for knitting non shaped terry areas. Loop yarn 25 is gradually pulled down by the downwardly moving needles, which move below the loop forming elements 17 to the lowermost position shown by needle No. 35 to therefore form loops L retained by elements 17. The base yarn 24 is fed through tube 30 of lowered base yarn Finger 29, under the advanced loop-forming element 17 through the throat plate 23. The first loop starts to form with the loop yarn between the thirty-one and the thirty-third needles, where the loop yarn is caught by a loop forming element; the thirty-third needle is already lower than the loop forming elements and, when moved lower, pulls down the base yarn 24. Both loop yarn and base yarn are moved downwardly by the twenty-third needle through an already knitted stitch held at level 13 which is the top edge of the needle cylinder 13'. The terry loops L are progressively getting longer as the needles move further down till cast-off occurs at about needle No. 35. Rleasing of the loop L occurs at about needle 39. The length of the loops can be changed by raising or lowering the dial 15.

At cast-off, a new stitch is completed with both yarns; the loop yarn is knitted into the fabric, together with the base yarn. After cast-off at the fifth, sixth or subsequent needle, the loop forming elements are withdrawn to release the loop yarn and the latter is sucked for trimming, as it happens in conventional heel shaping operation. The terry fabric is formed by loops at every second stitch. During withdrawal of the loop forming elements, the yarn loop engages the outer edge of the dial, resulting in the release of the loop.

The shaping of terry area is done by the heel forming device equipping the multifeed seamless hosiery machine. The loop yarn is fed by the yarn feeding finger 32 used for splicing. During widening operation, more and more needles are raised to their uppermost position and level to catch the loop yarn and the terry spot is expanded. There is a certain number of needles, for example about 80 in a 400-needle machine, selected as a group in the middle of the spot to be widened. This group is raised to the uppermost level 10''. During the widening operation, more and more needles, about 40—40 on each side of the group, will be selected and raised to the uppermost level, for example at every other course. Reaching the required width of the terry patch, the operation of the heel shaping device is ceased by an additional cam fitted to the selecting drum or control drum, depending on the type of the machine. After the requested length of the terry fabric is made, the operation of the needle selecting device is resumed for the narrowing process by another cam fitted to the control drum; this cam is shaped similarly to the original cam which starts to operate the selector. During the narrowing operation, the increased number of needles, for instance 40—40 on each side of the group of 80 needles, is gradually decreased. Less and less needles remain at the level 10'' and more and more needles knit at the regular knitting level 10'. When the desired shape of the terry area is formed, the narrowing operation is finished, the needle selecting device is out of action and the fabric of the body is knit to the press-off when the knitting of one article is completed and it is ejected from the machine.

The number of the loops in a square inch is determined by the quantity of loop forming elements. If loop forming elements operate in each slot of the dial, more loops will be formed and the terry fabric will be heavier than when a loop forming element is inserted only in every other, third or fourth slot. In the method of FIG. 9, shaped terry area is produced by proper needle selection. In a four-feed machine, the conventional slides and levers, for example, select the needles for make-up at No. 1 and No. 3 feeds where the heel splicing used to take place. When needle selection as for make-up is made at feed No. 1 and terry patch is needed with loops in every other course, another cam A, FIG. 5A, or another plunger is fitted to the dial cap at feed No. 3. This additional plunger might be controlled by the control drum.

In the lowermost position of the loop yarn finger 32, its feeding end is disposed at 32' just above the level of throat plate 23 and feeds loop yarn over the throat plate, so as to be caught by every other needle extending between the loop forming elements 17 and elevated to the regular knitting height 10'. When the loop yarn finger 32 is in its topmost position, shown at 10'' in FIG. 9, only those needles selected to attain a topmost position will catch the loop yarn fed by finger 32. In this latter position and with the loop forming elements in advanced position, shaped terry fabric can be knitted, there being variable numbers of knitting needles elevated to the topmost position by the selector cam means of the selector drum.

In the lowermost position of the loop yarn finger 32, terry fabric can be knitted continuously when every other needle is elevated to the regular knitting height 10'. Square or rectangular patches of terry fabric can be knitted at repeated intervals by appropriately moving only the loop yarn finger 32 between its lowermost and topmost position. The needles at regular knitting height are not catching the yarn in the latter position.

Figure 5B:
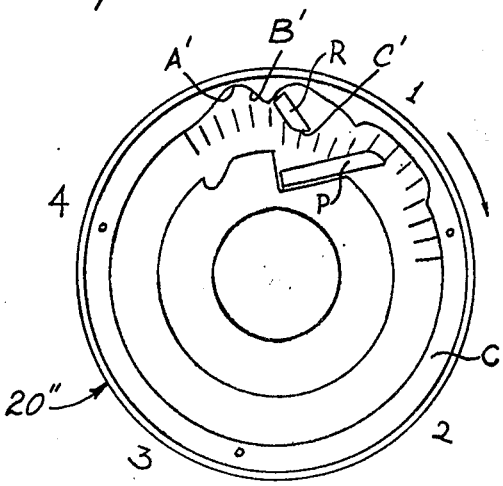
PRIOR ART Fig - 5B
FIG. 5B is a bottom plan view of a prior art dial cap for making a conventional double welt or an elasticized welt as well as for making terry.

If the terry patch is not shaped during knitting, but is made in a parallelogram form, the operation of the needle selecting device is not needed. This solution is obtained by positioning yarn feeding finger at its lower position 32' and by raising needles to regular height 10' (FIG. 9) for stitch forming in one-by-one needle selections when every other needle remains under the level of the loop forming elements in so-called welt position below the top 13 of the needle cylinder 13'. These needles are moved upwardly, starting at needle No. 38, by the edge of the rest cam under the stitch cam and raised to regular knitting level 10' by the raising cam to catch the yarn at the next feeding station wherein all needles knit. The rest cam and the raising cam are known parts of conventional circular knitting machines and are not shown in the figures. When terry is needed in every other course, the needles are selected to regular knitting level 10' and to welt position at No. 1 and No. 3 feeds where, for example, every odd needle knits and every even needle is in welt position. The needles in welt position do not knit and above them, the loop forming elements are protruded. At the next feeding station, all of the needles knit, that is all of the needles previously in the welt position, together with the remaining needles; at this next feeding station, the previous stitches on welting needles are cleared below the latches, such that tucking of yarn does not occur. When articles are needed with double welt and/or elastic knit-in welt combined with terry area in other portions of the same item, the modified transfer jacks 17*a*, with a double curved hook, are used in pairs, as it is shown in FIG. 7D. The prior art dial cap 20'' of FIG. 5B is used, together with pairs of transfer jacks 17*a*, as in FIGS. 7C and 7D. This prior art dial cap has a cam ring C which is much narrower than cam ring D of dial cap 20, shown in FIG. 5A. After the pairs of transfer jacks 17A have been pushed out by the make-up plunger P of FIG. 5B to catch the base yarn, the transfer jacks 17*a* are pulled back by the cam ring C only to clear away from the needles and to hold the loops until the transfer is made for completion of the double welt. This transfer is effected in conventional manner. The transfer jacks 17*a* are pushed out at A' by a conventional plunger (not shown) at B'; the needle hooks penetrate the O-shaped opening formed by the pair of transfer jacks 17*a* and take over the yarn loop held by the transfer jacks since the start of the double welt formation.

To make a terry area in the same item in which a double welt is made, the same dial cap 20'' and the same transfer jack 17*a* are used. The transfer jacks 17*a* are pushed out by the make-up plunger P to catch the loop yarn and the latter is released by plunger R at point C', which causes full retraction of the transfer jacks 17*a* inwardly of the outward edge of the dial, to thus release the loops. It does not matter whether the above-noted conventional plunger (not shown) is operative or not. It should be noted that point C' is as much inward as the outer edge of the cam race 20' of dial cap 20. It follows that for making terry, when the prior art dial cap 20'' is used with the transfer jacks 17*a*, the latter are fully retracted by plunger R inwardly of the outer edge of the dial to release the terry loops, while, when the dial cap 20 of FIG. 5A is used in combination with the loop forming elements 17, the latter are fully retracted inwardly of the outer edge of the dial by the cam race 20' to release the terry loops.

The double curve of the top edge of the hook (see FIG. 7C) serves a double purpose: it helps to provide a looser course in the make-up and it positively holds the yarn till the transfer, or when the terry is knit, till releasing the loop. When loop yarn 25 is laid over the double curve of the loop forming elements 17*a* at FIG. 7C, by the downwardly moving needles, the small sections of the yarn between the needles get a gentle stretch by the hump between the two curves. The same stretching effect takes place again during the releasing of the loop when the terry is knit, or when the stitch loops are taken over by the needles at the transfer in case of double welt knitting. The gentle stretches of each small section of the yarn laid in at the make-up certainly result in better stretch and a looser and more comfortable course in the make-up than when made with regular transfer jacks. The relatively tight make-up resulting from the use of the regular transfer jacks often causes discomfort for the wearer and also runs and damages in the fabric. The undulated hook is also advantageous for the loop forming elements 17 and 17' used individually or in pairs with blind elements 17*b*.

When the friction in the slot is too light, the loop on the hook could be lost before it should be released, causing defect in the fabric. It might happen, since the modified transfer jack has a lower hook than the regular one from which the yarn cannot be released by retracting the jack. If terry is knit for only a desired portion of the farbic, the loop yarn will be knit together with the base yarn as a reinforced panel in the non-terry area.

When no dial element is used, only additional cams are fitted to the control and the selecting drums to cease and resume the crotch shaping operation. If, instead of terry, plain reinforcement is made in the area; an enlarged heel patch is made. Producing panties by this simplest solution, no cam is needed in the dial cap and new attractive articles, with shaped, reinforced crotch, are produced on an otherwise practically obsolete four-feed machine, especially if the articles are made of stretch nylon yarn. For reinforcement, at the crotch, mercerized cotton yarn is used, which is particularly advantageous for sanitary purposes by its far better absorbency than the nylon has.

According to the arrangement of FIG. 5A, light and heavy terry can be knit in every fourth and/or every other course. Also, the light and the heavy terry portion could be repeated in the different sections of the same article by changing the yarn fingers only. This could be combined with the operation of the make-up plunger when only high butt or/and low butt dial elements are actuated by plunger P.

Also, the thickness of the stationary cam A could be added the the variation: it could be made of thin material to reach and actuate only the high butt loop forming elements. A wide range of the terry products could be achieved by these solutions, especially on coarse machines when the loop forming elements could be operated between the needles, protruded constantly and no needle selection is needed. A foot with light terry and heavy sole portion or a panty of light terry reinforced with heavy terry crotch could be easily manufactured by this system.

Figure 11:
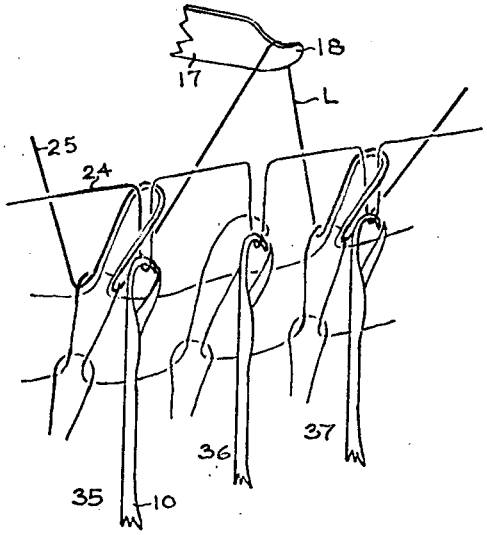
FIG. 11 is a perspective schematic view showing the loop and stitch formation at cast-off with the loop yarn knitted into the fabric with the base yarn.
Figure 12:
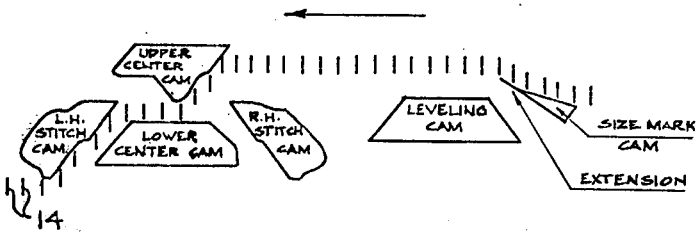
FIG. 12 is a schematic elevation of the cam arrangement in the cylinder for actuating the needles in a double feed machine known under the Trade Mark "Fidelity," owned by Singer Machine Co. (Fidelity Division)

FIG. 11 clearly shows a loop yarn and base yarn knitted together with one loop still retained on an advanced loop forming element. Loops are formed at every second stitch. FIG. 11 shows the right side of the knitted fabric and the floating stitch of the loop yarn. FIG. 11 also illustrates the cast-off when needles Nos. 36 and 37 just start their upward movement. The base yarn is knocked over together with the loop yarn at needles Nos. 35 and 37, while the loop yarn is held on the advanced loop forming element 17 above needle No. 36. The figure also shows the new loops drawn through the previously knitted stitch of an already formed wale. The stitches formed by needle No. 36 are made only of base yarn. The drum cam needed for one-by-one needle selection and the cam which operates the make-up cam in the dial, are moved to that spot of the main drum where the terry area is made. The base yarn is fed by the lowered yarn finger under the throat plate, as shown in FIGS. 6A, 9, and 10 and the loop yarn is laid above the throat plate. Producing terry fabric at the main feed of the double feed machine, the terry area is as wide as there are needles raised to catch the loop yarn. The loop yarn is exposed in every other course of the fabric, all over where the loops are not formed. To eliminate the appearance of the loop yarn in every second course of the fabric which occurs due to the original construction of the double feed machine, the following modifications are needed, for example on a dual feed "Fidelity" machine, which operates with continuous rotation. As shown in FIG. 12, the "size mark" cam in the switch cam bracket is extended to raise the needles to a higher level than could be done by the original shape of this cam.

FIG. 12 shows the extension made to the original size mark cam. As the needles are already selected for "one by one" by the makeup selector, only every other needle will be raised by this modified size mark cam to the height of the highest section of the upper center cam in the cam ring assembly. By cutting off the right-hand portion of the upper center cam, the retracting side of this cam is extended to delay the draw down movement of the needles pushed up by the modified size mark cam to a higher level than used to be done.

The higher level of the needle thus obtained is needed to catch the extra yarn for loop forming or for plain reinforcement in the desired area of the fabric. The switch cam, the saftey cam from the switch cam bracket and the right-hand cover cam from the cam ring assembly and pickers as well, are removed to permit free movement of the needles up to the new elevation. Using the principles of this modification of the size mark cam and of the upper center cam previously described, any other type of double feed machine can be converted to knit square shaped form terry areas or only plain reinforced patch produced by adding an extra yarn to a requested area. In the case of only plain reinforcement, loop forming elements are not needed. The ends of this extra yarn are trimmed at the border of the terry or plain reinforced area by the conventional cutter. Although this cutting does not provide a perfectly sheer cut, especially at the tail side of the terry area, as it is done at heel reinforcement by burner or special trimmer device, it is acceptable when the yarn end is blended into the contour of the terry area. When panties, bikinis with a terry fabric crotch are produced on the double feed machine, the length of the trimmed yarns ends is negligible, because the edge of the terry area is cut out on both sides when the legs of the panties are tailored.

Referring to FIGS. 9, 10, and 11, it should be noted that loop forming elements could be operated between each knitting needle, so as to obtain a loop at each stitch and, therefore, a very close terry fabric. This is achieved on a machine possessing about 17–18 needles per inch and the same number of loop forming elements are operated in the dial as needles are working in the cylinder. On a 3¾ × 200-needle machine, operated with 200 slots in the dial and the required loop forming elements continuously protruded between the needles, the terry fabric is produced in the desired area by actuating only the loop yarn finger. Terry fabric can be knitted all around and changed for plain fabric in the same piece of article continually, or only in a desired area, by appropriately moving in and out the loop yarn finger 32 at those feeds where the terry is required, while the base yarn is constantly fed by finger 29. This is the most productive and versatile performance of this process. Warm pantyhose or leotards, for example, with terry panty-portion, plain legs and again terry sole or whole foot portion, can be manufactured by this method.

This system also provides perfect plating when two different quality of yarns or different colours are used.

Figure 13:
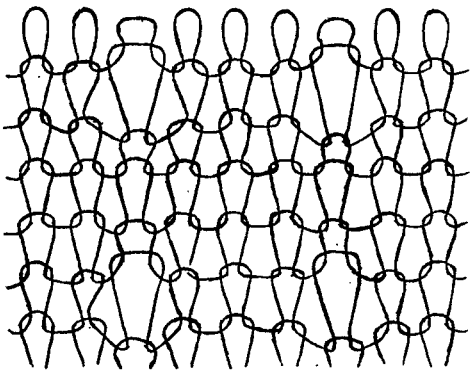
FIG. 13 is an elevation of the reverse side of an eyelet-like lace pattern effect in a knitted fabric obtained with the modified knitting machine.

The modified machines can also be used for making knitted fabric with enlarged stitches, in accordance with many desired patterns, to achieve a decorative lace effect, as shown in FIG. 13. This is obtained by feeding loop yarn only, without the use of the base yarn, and the loop yarn being fed above the loop forming elements and by selecting the loop forming elements to be advanced. The lace-like effect is obtained in a much simpler way than with the conventional method where complicated equipment and special needles have to be used with less productivity. In the present method, the lace pattern effect is obtained in a simple way when the sinker loops connecting two adjacent needle loops are enlarged by the advanced loop forming elements. The dimension of the eyelet can be varied by raising or lowering the dial and/or holding the loop for two or three consecutive feeds. This patterning method can be applied to jersey and also to other construction of knit fabrics when the needles and loop forming elements are alternately working in the dial. This patterning method gives the feasibility of producing, for example, a panty made of porous fabric and provided with terry crotch when feeding the yarn only above the dial elements at one feed and changing the feeding for above and under the dial elements at those feeds where terry fabric is required.

FIG. 13 shows a reverse side of the eyelet-like porous pattern effect achieved by laying the yarn only above the loop forming elements at every fourth course and with the loop forming elements working in every second slot, that is at every fourth needle, since the number of slots in the dial is half the number of needles in the cylinder. At the other three feeds of the machine, the yarn is guided only under the loop forming elements.

What I claim is:

1. In a circular knitting machine for producing plain and terry knitted fabric, a rotatable needle cylinder having a top edge, knitting needles movable up and down in said cylinder, a rotatable dial coaxial with said needle cylinder, vertically adjustable relative to said cylinder and disposed above the latter, said dial having a series of radial slots extending to the outer edge of said dial, a series of loop forming elements located in the slots, a vertically adjustable stationary dial cap defining a cam race engaged by said loop forming elements for radially moving the same at right angles to said needles between a retracted position inwardly of said dial outer edge and inwardly of said needles and an advanced position extending beyond said dial outer edge and beyond said needles, said loop forming elements disposed in a plane above said needle cylinder top edge and each having a hook formed by an upwardly inclined tip capable of retaining a yarn loop thereon and of allowing release of said loop by engagement with the dial outer edge upon retracting movement of said loop forming element within said dial, a stationary throat plate having a radially inner edge disposed outwardly of and close to said needles and located just above the loop forming elements, said throat plate having a slot made therethrough radially inwardly extending and opening at said inner edge of said throat plate, a pair of yarn feeding fingers pivoted about a horizontal stationary axis and each having a yarn carrying and feeding end vertically movable above said throat plate, one of said fingers being a loop yarn feeding finger and pivotable with its feeding end moving between a topmost position well above said throat plate and a lowermost position just above said throat plate, the other of said fingers being a base yarn feeding finger pivotable in a plane in vertical alignment with said throat plate slot with its feeding end moving between a topmost position well above said throat plate and a lowermost position extending through said throat plate slot to feed yarn below said throat plate, the needles between loop forming elements raisable to a regular knitting position above the level of said throat plate, and a variable number of said last-named needles raisable to a topmost position at a higher level than said regular knitting position, said regular knitting position and topmost position being taken by said needles prior to their reaching said base yarn feeding finger, so constructed and arranged that, when said base yarn feeding finger end is in its topmost position, no needle catches the base yarn fed thereby, and when in lowermost position, all raised needles catch the base yarn fed thereby for knitting said base yarn, and when said loop yarn finger end is in lowermost position, all raised needles catch the loop yarn fed thereby, and when said loop yarn finger end is in said topmost position, only the needles selected by said selector cam means in reaching their topmost position catch the loop yarn fed from said loop yarn finger, the loop yarn knitted by said needles being caught by the advanced loop forming elements and released upon retraction of said loop forming elements.

2. In a circular knitting machine as claimed in claim 1, wherein said throat plate slot is of substantially uniform width and further including a bow-shaped part fixed underneath said throat plate and having an end portion extending across and beyond the downstream edge of said slot in the direction of cylinder rotation, said downstream edge having a curved terminal corner edge to define a restricted opening for said slot, said bow-shaped part having a wedge underface to positively engage and pivot down flying knitting needle latches.

3. In a circular knitting machine as claimed in claim 2, wherein said bow-shaped part defines at the underface of said throat plate a downwardly extending step on the upstream side of said slot with respect to needle cylinder movement and said base yarn feeding finger carries a yarn guiding tube at its feeding end engaged through said slot in the lowermost position of said base yarn feeding finger and protruding from the underface of said throat plate but terminating short of the underface of said bow-shaped part.

4. In a circular knitting machine as claimed in claim 1, wherein the top edge of said upwardly inclined tip of the hook of said loop forming element forms a double curve.

5. In a circular knitting machine as claimed in claim 2, wherein said loop forming elements are disposed in pairs in each slot of the dial with the hooks co-extensive but bent out laterally to form an O-shape when seen in top plan view.

* * * * *